US009382806B2

(12) United States Patent
Hoeger et al.

(10) Patent No.: US 9,382,806 B2
(45) Date of Patent: Jul. 5, 2016

(54) INTERMEDIATE HOUSING OF A GAS TURBINE HAVING AN OUTER BOUNDING WALL HAVING A CONTOUR THAT CHANGES IN THE CIRCUMFERENTIAL DIRECTION UPSTREAM OF A SUPPORTING RIB TO REDUCE SECONDARY FLOW LOSSES

(75) Inventors: Martin Hoeger, Erding (DE); Inga Mahle, Munich (DE); Jochen Gier, Karlsfeld (DE)

(73) Assignee: MTU Aero Engines GmbH, Munich (DE)

( * ) Notice: Subject to any disclaimer, the term of this patent is extended or adjusted under 35 U.S.C. 154(b) by 830 days.

(21) Appl. No.: 13/699,202

(22) PCT Filed: Jan. 16, 2012

(86) PCT No.: PCT/DE2012/000032

§ 371 (c)(1),
(2), (4) Date: Nov. 20, 2012

(87) PCT Pub. No.: WO2012/097798

PCT Pub. Date: Jul. 26, 2012

(65) Prior Publication Data

US 2013/0064657 A1 Mar. 14, 2013

(30) Foreign Application Priority Data

Jan. 19, 2011 (DE) ..... 10 2011 008 812

(51) Int. Cl.

| | |
|---|---|
| ***F01D 9/02*** | (2006.01) |
| ***F01D 25/14*** | (2006.01) |
| ***F01D 25/24*** | (2006.01) |
| ***F01D 5/14*** | (2006.01) |

(52) U.S. Cl.

CPC *F01D 9/02* (2013.01); *F01D 5/143* (2013.01); *F01D 25/14* (2013.01); *F01D 25/24* (2013.01); *F05D 2240/11* (2013.01); *F05D 2270/17* (2013.01)

(58) Field of Classification Search

CPC ..... F01D 5/143; F01D 9/02; F01D 25/14; F01D 25/24; F04D 29/403; F05D 2270/17; F05D 2240/11; F05D 2240/80

See application file for complete search history.

(56) References Cited

U.S. PATENT DOCUMENTS

| | | | | |
|---|---|---|---|---|
| 6,017,186 | A | 1/2000 | Hoeger et al. | |
| 7,320,574 | B2 * | 1/2008 | Greim | F01D 5/225 415/170.1 |

(Continued)

FOREIGN PATENT DOCUMENTS

| | | |
|---|---|---|
| DE | 102008021053 | 10/2009 |
| DE | 10 2008 060 847 | 6/2010 |

(Continued)

*Primary Examiner* — Richard Edgar
*Assistant Examiner* — Brian P Wolcott
(74) *Attorney, Agent, or Firm* — Davidson, Davidson & Kappel, LLC

(57) ABSTRACT

Intermediate housing (14), in particular of turbines (11, 13) of a gas turbine engine, having a radially inner bounding wall (23) and having a radially outer bounding wall (24, 24'), having a crossflow channel (33), which is formed by the bounding walls (23, 24, 24') and within which at least one supporting rib (15) is positioned that has a leading edge (16), a trailing edge (17), as well as side walls (18) extending between the leading edge (16) and the trailing edge (17) that direct a gas flow traversing the crossflow channel (33); the radially outer bounding wall (24) having a contour that changes in the circumferential direction at least in one section upstream of the supporting rib (15).

10 Claims, 3 Drawing Sheets

(56) References Cited

U.S. PATENT DOCUMENTS

| | | | | |
|---|---|---|---|---|
| 8,132,417 | B2 | 3/2012 | Steiger et al. | |
| 2006/0127214 | A1 | 6/2006 | Glasspole | |
| 2007/0258818 | A1 | 11/2007 | Allen-Bradley et al. | |
| 2008/0276621 | A1 | 11/2008 | Somanath | |
| 2010/0172749 | A1* | 7/2010 | Mitsuhashi | F01D 5/143 415/193 |
| 2011/0225979 | A1 | 9/2011 | Hoeger et al. | |

FOREIGN PATENT DOCUMENTS

| | | |
|---|---|---|
| EP | 0846867 | 6/1998 |
| EP | 1 760 257 | 3/2007 |
| EP | 2 136 033 | 12/2009 |
| EP | 2 248 996 | 11/2010 |
| EP | 2261462 | 12/2010 |
| WO | WO 2009/019282 | 2/2009 |
| WO | WO 2010/000788 | 1/2010 |

* cited by examiner

INTERMEDIATE HOUSING OF A GAS TURBINE HAVING AN OUTER BOUNDING WALL HAVING A CONTOUR THAT CHANGES IN THE CIRCUMFERENTIAL DIRECTION UPSTREAM OF A SUPPORTING RIB TO REDUCE SECONDARY FLOW LOSSES

The present invention relates to an intermediate housing, in particular of turbines of a gas turbine engine.

BACKGROUND

A multi-shaft fluid energy machine, for example, a multi-shaft gas turbine engine, has a plurality of compressor components, at least one combustion chamber and a plurality of turbine components. Thus, a dual-shaft gas turbine engine has a low-pressure compressor, a high-pressure compressor, at least one combustion chamber, a high-pressure turbine, as well as a low-pressure turbine. A triple-shaft gas turbine engine has a low-pressure compressor, a medium-pressure compressor, a high-pressure compressor, at least one combustion chamber, a high-pressure turbine, a medium-pressure turbine, and a low-pressure turbine.

FIG. 1 shows a highly schematized detail of a multi-shaft gas turbine engine in the area of a rotor 10 of a high-pressure turbine 11, as well as of a rotor 12 of a low-pressure turbine 13. Extending between high-pressure turbine 11 and low-pressure turbine 13 is an intermediate housing 14 having a crossflow channel 33 for delivering the flow exiting high-pressure turbine 11 to low-pressure turbine 13, at least one supporting rib 15 being positioned in crossflow channel 33.

Supporting rib 15 is a stator-side component that directs the flow traversing crossflow channel 33. Such a flow-directing supporting rib 15 has a leading edge 16, also referred to as a flow entry edge, a trailing edge 17, also referred to as a flow exit edge, and side walls 18.

A cavity 19 can open through from a radial outer region (see FIG. 1) into crossflow channel 33 upstream of supporting ribs 15 in the area of an entry into crossflow channel 33, respectively in the area of a leading edge 34 of intermediate housing 14, and cooling air 21*a* can be discharged through the same to a small degree and mix with gas flow 20 exiting high-pressure turbine 11. This cavity 19 is located between the HPT housing and intermediate housing 14 and is sealed by a seal 21*c*. Only a weak leakage flow 21*b* flows through this seal 21*c* since the HPT housing and intermediate housing 14 cannot be permanently joined to one another.

To allow leakage 21*a* to enter into crossflow channel 33 and prevent gas flow 20 from flowing in via cavity 19, the static pressure of gas flow 20 in the inlet zone of cavity 19 is below the pressure of cooling air 21*b* in secondary air zone 21*d* outside of the annular space.

As can be inferred from FIG. 2, in the case of the related-art fluid energy machine in accordance with FIG. 1, a pressure rise $+\Delta p$ in the static pressure ensues upstream of leading edges 16 of supporting ribs 15 due to a blocking of the gas flow traversing crossflow channel 33 at circumferential positions where the supporting ribs are positioned, whereas in accordance with FIG. 2, a pressure drop $-\Delta p$ in the static pressure ensues at circumferential positions between adjacent supporting ribs 15. A dimensionless circumferential direction u/t is shown in FIG. 2, t corresponding to the supporting rib pitch in circumferential direction u.

The pressure fields of pressure rise $+\Delta p$ illustrated by dashed lines in FIG. 2 at the circumferential positions of supporting ribs 15 and of pressure drop $-\Delta p$ at the circumferential positions between adjacent supporting ribs 15, upstream of leadings edges 16 of supporting ribs 15, respectively, extend into cavity 19, so that a dissipative secondary flow 22 develops in the orifice area of cavity 19 and in crossflow channel 33. In addition, in accordance with FIG. 2, the pressure fluctuation in the cavity leads to a greater pressure differential between gas flow 20 and cooling-air flow 21*b*, ultimately increasing leakage and resulting in a degraded efficiency of the fluid energy machine.

SUMMARY OF THE INVENTION

It is an object of the present invention to provide an intermediate housing which will make it possible to increase the efficiency.

The present invention provides an intermediate housing, in particular of turbines of a gas turbine engine, having a radially inner bounding wall and having a radially outer bounding wall, having a crossflow channel, which is formed by the bounding walls and within which at least one supporting rib is positioned that has a leading edge, a trailing edge, as well as side walls extending between the leading edge and the trailing edge that direct the gas flow traversing the crossflow channel, wherein the radially outer bounding wall has a contour that changes in the circumferential direction at least in one section upstream of the supporting rib.

In accordance with the present invention, the radially outer bounding wall features a contour that changes in the circumferential direction at least in one section upstream of the supporting rib.

The present invention makes it possible to efficiently counteract the formation of the dissipative secondary flow that develops in accordance with the related art in the cooling-air flow channel. Since it is possible to work with a smaller pressure differential between the gas flow and the cooling-air flow, the efficiency may be improved over the related art.

BRIEF DESCRIPTION OF THE DRAWINGS

Preferred embodiments of the present invention are derived from the dependent claims and from the following description. Non-limiting exemplary embodiments of the present invention are described in greater detail with reference to the drawing, whose figures show:

DETAILED DESCRIPTION

Figure 1:
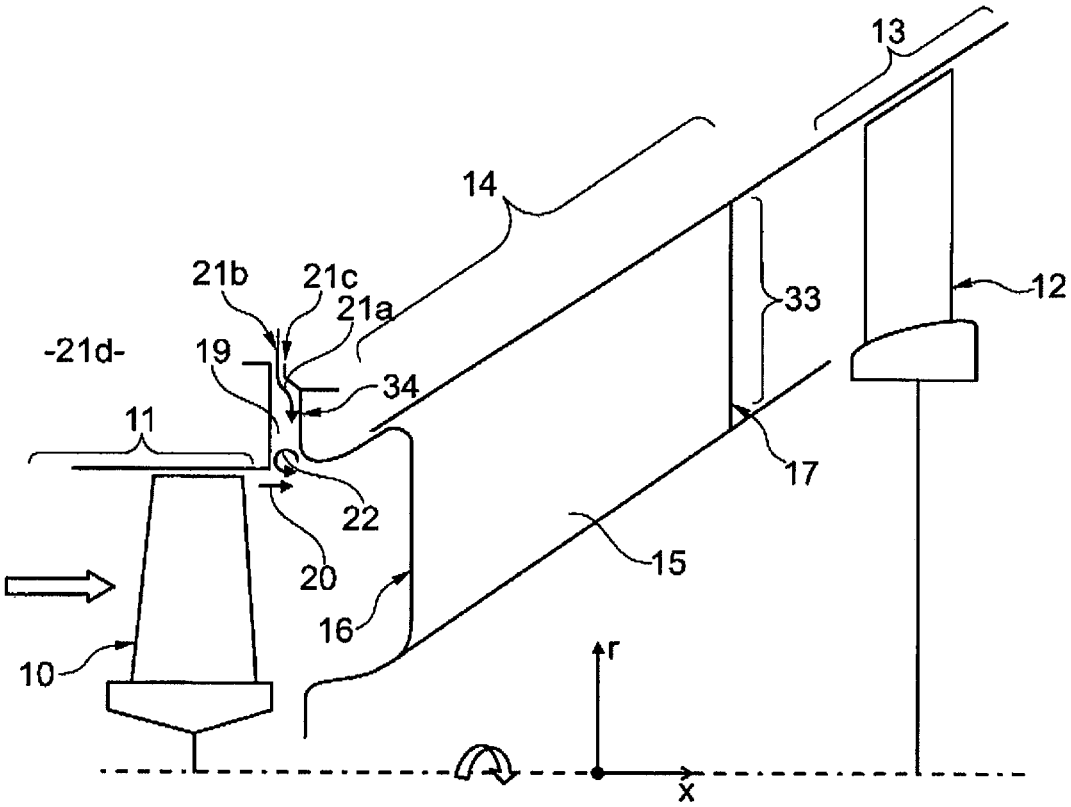
Fig. 1 Prior Art
FIG. 1 a highly schematized, partial longitudinal section through a fluid energy machine known from the related art in the area of an intermediate housing and thus flow channel between two turbine components.
Figure 2:
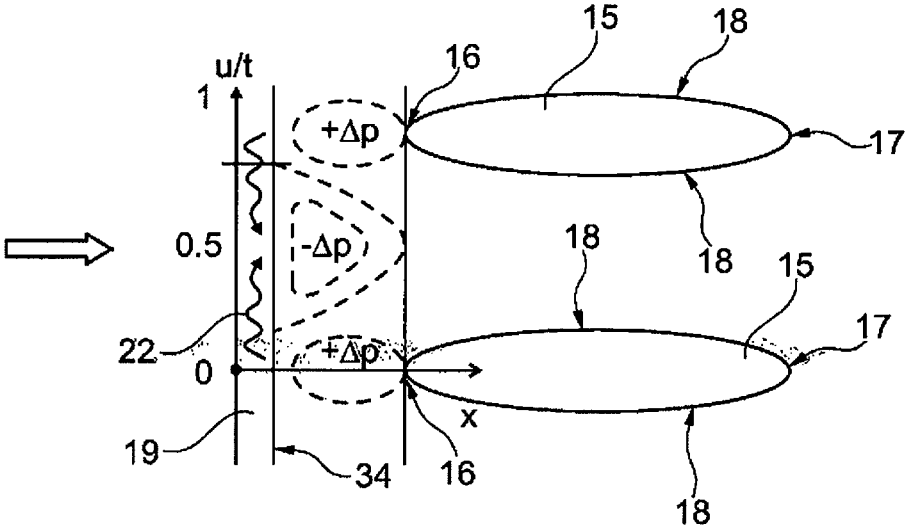
Fig. 2 Prior Art
FIG. 2 a detail of the configuration of FIG. 1 in a radial direction of view.

The present invention relates to the field of multi-shaft fluid energy machines, in particular, multi-shaft gas turbine engines, having a plurality of compressor components, as well as a plurality of turbine components. The basic design of such a fluid energy machine is familiar to one skilled in the art and has already been described in connection with FIG. 1.

The present invention relates to details of an intermediate housing 14 of a fluid energy machine of this kind, which makes it possible to improve the entry of a cooling-air flow directed in a cooling-air flow channel 19 into the gas flow directed by crossflow channel 33 of intermediate housing 14, namely in an inlet zone of crossflow channel 33 upstream of supporting ribs 15 positioned in the same.

The present invention may be used both for an intermediate housing 14 of a dual-shaft fluid energy machine that extends between a high-pressure turbine 11 and a low-pressure turbine 13, as well as for an intermediate housing of a triple-shaft fluid energy machine that extends between a high-pressure turbine and a medium-pressure turbine, or between a medium-pressure turbine and a low-pressure turbine.

Figure 3:
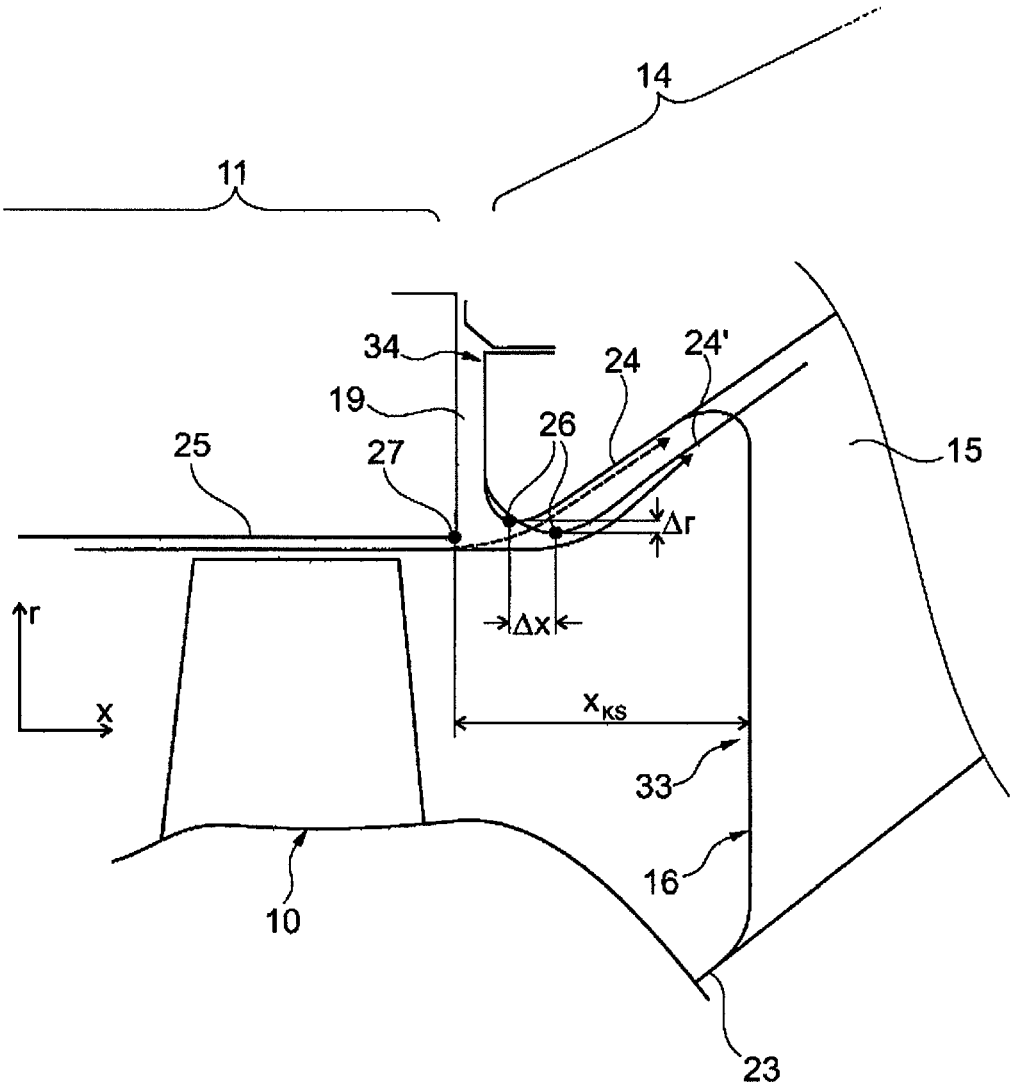
FIG. 3 a highly schematized, partial longitudinal section through a fluid energy machine in the area of an intermediate housing according to the present invention that is positioned between two turbine components.

FIG. 3 shows a detail of a fluid energy machine in the area of an intermediate housing 14, of a crossflow channel 33 of this intermediate housing 14, and of a turbine component that is positioned upstream of crossflow channel 33, and is designed as a high-pressure turbine 11 in the illustrated exemplary embodiment; in accordance with FIG. 3, cooling-air flow channel 19 leading through from a radially outer region into crossflow channel 33, namely upstream of supporting ribs 15 which are positioned in crossflow channel 33. In this context, cooling-air flow channel 19 is bounded in portions thereof by leading edge 34 of intermediate housing 14.

Crossflow channel 33 is bounded radially inwardly by a stator-side bounding wall 23 and radially outwardly likewise by a stator-side bounding wall 24.

A bounding wall 25 of high-pressure turbine 11 is adjacent radially outwardly to rotor 10 of high-pressure turbine 11.

To render possible an unrestricted entry of cooling air directed by cooling-air flow channel 19 into the gas flow exiting high-pressure turbine 11 and directed from crossflow channel 33 of intermediate housing 14, radially outer bounding wall 24 of crossflow channel 33 features a contour that changes in the circumferential direction at least in one section upstream of supporting ribs 15.

Radially outer bounding wall 24 of crossflow channel 33 preferably features a contour that changes in the circumferential direction at least in one transition section between leading edge 34 of intermediate housing 14 and crossflow channel 33.

In accordance with FIG. 3, this contour of radially outer bounding wall 24 of crossflow channel 33, that changes in the circumferential direction, may also extend into a region downstream of leading edges 16 of supporting ribs 15; FIG. 3 illustrating two contours 24 and 24' configured at different circumferential positions u/t for the radially outer bounding wall of crossflow channel 33.

In the inlet zone of crossflow channel 33 upstream of leading edges 16 of supporting ribs 15, the radially outer bounding wall 24 of crossflow channel 33 features a bounding wall section, respectively bounding wall point 26 of minimal radius of curvature and, accordingly, maximal curvature.

The contour of radially outer bounding wall 24 of crossflow channel 33 changes in the circumferential direction, u respectively u/t in such a way that an axial position (axial direction x) and/or a radial position (radial direction r) of bounding wall section, respectively bounding wall point 26 of minimal radius of curvature change(s) in circumferential direction u, respectively u/t.

Preferably both the axial position, as well as the radial position of bounding wall point 26 of minimal radius of curvature change in the circumferential direction. However, one possible, simplified practical implementation of the present invention provides that exclusively the axial position or exclusively the radial position of this bounding wall point 26 change in the circumferential direction.

The axial position of bounding wall point 26 of minimal radius of curvature changes in circumferential direction u, respectively u/t in such a way that this bounding wall point 26 is offset, respectively positioned in axial direction x, maximally upstream approximately at the circumferential position of leading edges 16 of supporting ribs 16 and, in axial direction x, maximally downstream approximately at a circumferential position of one half pitch between two adjacent supporting ribs. The axial position of bounding wall point 26 changes continuously in the circumferential direction between these maximum upstream and downstream axial positions.

The radial position of bounding wall point 26 of minimal radius of curvature changes in circumferential direction u, respectively u/t in such a way that this bounding wall point 26 is offset, respectively positioned in radial direction r, maximally radially outwardly at the circumferential position of leading edges 16 of supporting ribs 16 and, in radial direction r, maximally radially inwardly approximately at a circumferential position of one half pitch between two adjacent supporting ribs 15. The radial position of bounding wall point 26 changes continuously in the circumferential direction between these maximum radially inner and radially outer radial positions.

Contour 24 shown in FIG. 3 of the radially outer bounding wall of crossflow channel 33 corresponds to the contour of the same approximately at the circumferential position of a leading edge 16 of a supporting rib 15, whereas contour 24' shown in FIG. 3 corresponds to the contour of the same approximately at a circumferential position of one half pitch between two adjacent supporting ribs 15.

Further details pertaining to the offset of the axial position, as well as radial position of bounding wall point 26 of minimal radius of curvature in circumferential direction u, respectively u/t, are described in the following with reference to FIG. 4.

Figure 4:
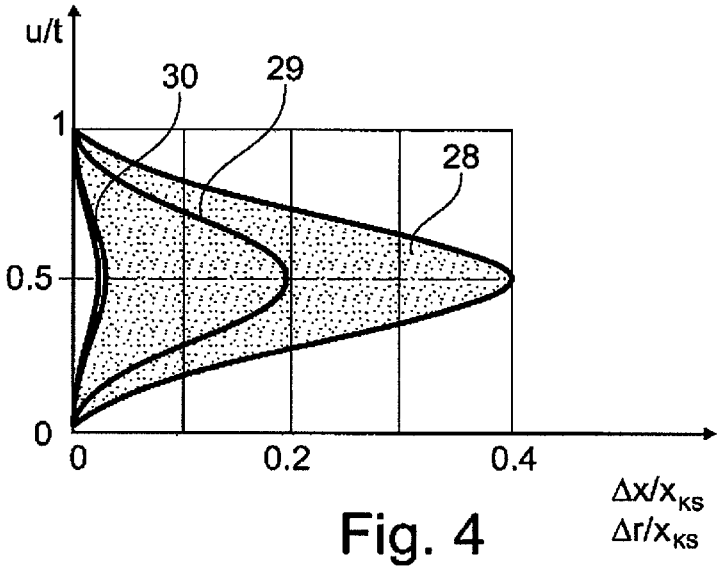
FIG. 4 a diagram for illustrating the present invention.

Plotted on the horizontal axis in FIG. 4 is an absolute value ratio $\Delta x/x_{KS}$ between axial distance $\Delta x$ (see FIG. 3) of the downstream axial position and the maximum upstream axial position of bounding wall point 26 of minimal radius of curvature and axial distance $x_{KS}$ (see FIG. 3) of a downstream end 27 of radially outer bounding wall 25 of turbine component 11 and of leading edge 16 of supporting ribs 15 positioned upstream of crossflow channel 33. Also plotted in FIG. 4 on the horizontal axis is an absolute value ratio $\Delta r/x_{KS}$ between radial distance $\Delta r$ (see FIG. 3) of the maximum radially outer radial position and of the radially inner radial position of bounding wall point 26 of minimal radius of curvature, and this axial distance $x_{KS}$. As already mentioned, $x_{KS}$ (see FIG. 3) corresponds to the distance between downstream end 27 of radially outer bounding wall 25 of high-pressure turbine 11 and leading edge 16 of supporting ribs 15.

In FIG. 4, dimensionless circumferential direction u/t is plotted on the vertical axis, a leading edge 16 of a supporting rib 15 being positioned at circumferential positions u/t=0 and u/t=1, respectively, and a circumferential position u/t=0.5 corresponding to a circumferential position in the middle between two adjacent supporting ribs 15.

Thus, it may be inferred from FIG. 4 that ratios $\Delta x/x_{KS}$ and $\Delta r/x_{KS}$ continuously change when considered in dimensionless circumferential direction u/t between two adjacent supporting ribs 15; at circumferential position u/t=0.5 of approximately one half pitch between two adjacent supporting ribs 15, ratio $\Delta x/x_{KS}$ and thus the offset of the axial position of bounding wall point 26 of minimal radius of curvature in the downstream direction, as well as ratio $\Delta r/x_{KS}$ and thus the offset of the radial position of bounding wall point 26 of minimal radius of curvature in the radially inward direction being the greatest, and these ratios and thus offsets being the smallest approximately at circumferential positions u/t=0 and u/t=1 where leading edges 16 of supporting ribs 15 are positioned.

Region 28 of FIG. 4 visually represents a preferred range of validity for ratio $\Delta x/x_{KS}$ and/or $\Delta r/x_{KS}$ that change(s) in circumferential direction u, respectively u/t, and thus the offset of the axial position and/or of the radial position of bounding wall point 26 of minimal radius of curvature, that changes in circumferential direction u, respectively u/t.

Ratios $\Delta x/x_{KS}$ and $\Delta r/x_{KS}$ amount to up to 40%.

Ratios $\Delta x/x_{KS}$ and $\Delta r/x_{KS}$ at circumferential position u/t=0.5 of approximately one half pitch between two supporting ribs 15 amount maximally to 40% and minimally to 2%. Ratios $\Delta x/x_{KS}$ and $\Delta r/x_{KS}$ at circumferential positions u/t=0 and u/t=1 amount to 0%. These ratios $\Delta x/x_{KS}$ and $\Delta r/x_{KS}$ change therebetween continuously and preferably not linearly.

In particular, ratio $\Delta x/x_{KS}$ changing in circumferential direction u, respectively u/t at circumferential position u/t=0.5 of approximately one half pitch between two supporting ribs 15, is in particular between 2% and 25%.

Ratio $\Delta r/x_{KS}$ changing in circumferential direction u, respectively u/t at circumferential position u/t=0.5 of approximately one half pitch between two supporting ribs 15, amounts, in particular, to between 2% and 5%.

Curve 29 within region 28 visually represents preferred ratio $\Delta x/x_{KS}$ that changes in the circumferential direction, and thus the offset of the axial position of bounding wall point 26 of minimal radius of curvature, that changes in the circumferential direction; in accordance with curve 29, the offset of the axial position in the area of half pitch between two adjacent supporting ribs being the greatest, and ratio $\Delta x/x_{KS}$ amounting approximately to 20%.

Curve 30 within region 28 illustrates preferred ratio $\Delta r/x_{KS}$ that changes in the circumferential direction, and thus the offset of the radial position of bounding wall point 26 of minimal radius of curvature, that changes in the circumferential direction; in the case of approximately half pitch between adjacent supporting ribs, ratio $\Delta r/x_{KS}$ being approximately 2.5%, and the offset of the radial position in the area of half pitch between two adjacent supporting ribs being the greatest.

Considered in the circumferential direction, the offset of the axial position of bounding wall point 26 of minimal radius of curvature and the offset of the radial position of bounding wall point 26 of minimal radius of curvature, respectively above ratios $\Delta x/x_{KS}$ and $\Delta r/x_{KS}$ each change continuously and preferably not linearly.

Figure 5:
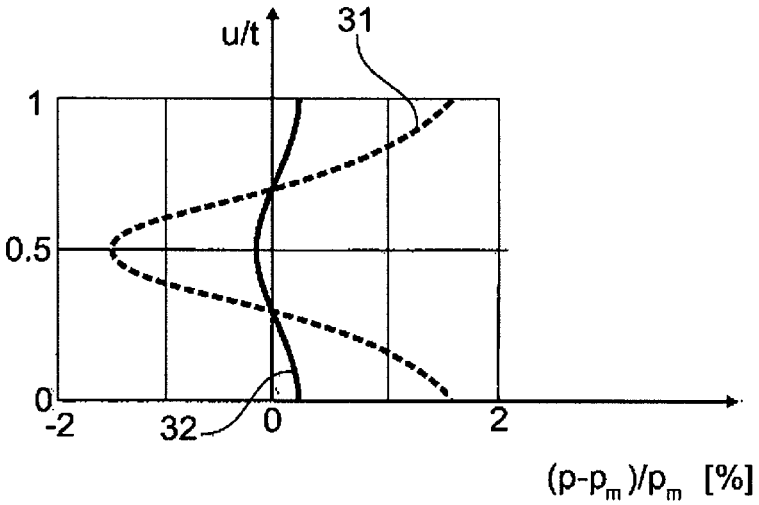
FIG. 5 a further diagram for illustrating the present invention.

FIG. 5 visually represents the effect of the contouring according to the present invention of radially outer bounding wall 24 of crossflow channel 33; a ratio $(p-p_m)/p_m$ between difference $(p-p_m)$ of static pressure p of the gas flow in crossflow channel 14 and mean value $p_m$ of this static pressure and mean value $p_m$ being plotted on the horizontal axis in FIG. 5, and dimensionless circumferential direction u/t being plotted on the vertical axis.

Curve 31 of FIG. 5 corresponds to a profile of ratio $(p-p_m)/p_m$ that ensues in accordance with the related art, and curve 32 to the profile of ratio $(p-p_m)/p_m$, that ensues in accordance with the present invention.

It may be inferred from FIG. 5 that the present invention makes it possible to provide an improved, uniform pressure profile of the static pressure in the circumferential direction, making it possible to effectively counteract the formation of a secondary flow in the orifice section of cooling-air flow channel 19 into crossflow channel 33. An unrestricted entry of cooling-air flow into crossflow channel 33 may be thereby ensured, making it possible to improve the efficiency of the fluid energy machine. In addition, the flow in crossflow channel 33 may be improved between adjacent supporting ribs 15.

What is claimed is:

1. A housing comprising:

a radially inner bounding wall;

a radially outer bounding wall;

a plurality of supporting ribs within a crossflow channel defined by the radially inner and outer bounding walls, the supporting ribs having a leading edge, a trailing edge, and side walls extending between the leading edge and the trailing edge, the side walls directing gas flow traversing the crossflow channel;

the radially outer bounding wall having a contour changing in a circumferential direction at least in one section upstream of the supporting ribs;

the housing being an intermediate housing of two turbines of a gas engine;

wherein an axial position of the bounding wall section or of a bounding wall point of minimal radius of curvature changes in the circumferential direction in such a way that the bounding wall point is positioned maximally upstream at a circumferential position of the leading edge of the supporting ribs, and maximally downstream at a circumferential position of one half pitch between two adjacent supporting ribs of the plurality of supporting ribs; or wherein a radial position of the bounding wall section or of the bounding wall point of minimal radius of curvature changes in the circumferential direction in such a way that the bounding wall point is positioned maximally radially outwardly at a circumferential position of the leading edge of the supporting ribs, and maximally radially inwardly at a circumferential position of one half pitch between two adjacent supporting ribs of the plurality of supporting ribs.

2. The housing as recited in claim 1 wherein the contour changes in the circumferential direction at least in one transition section between a leading edge of the intermediate housing and the crossflow channel.

3. The housing as recited in claim 1 wherein an absolute value ratio of an axial distance between the maximum downstream and the maximum upstream axial positions of the bounding wall point of minimal radius of curvature over an axial distance between a downstream end of a radially outer bounding wall of a turbine component positioned upstream of the crossflow channel and the leading edge of the supporting ribs amounts to up to 40%.

4. The housing as recited in claim 3 wherein the absolute value ratio amounts to up to 25%.

5. The housing as recited in claim 1 wherein an absolute value ratio of a radial distance between the maximal radially outer and the maximal radially inner position of the bounding wall point of minimal radius of curvature over an axial distance between a downstream end of the radially outer bounding wall of a turbine component positioned upstream of the crossflow channel and the leading edge of the supporting ribs amounts to up to 40%.

6. The housing as recited in claim 5 wherein the absolute value ratio amounts to up to 5%.

7. The housing as recited in claim 1 wherein the side walls are both concave.

8. A gas engine comprising:

a first turbine;

a second turbine; and the housing as recited in claim 1 located between the first and second turbines.

9. A housing comprising:

a radially inner bounding wall;

a radially outer bounding wall;

a plurality of supporting ribs within a crossflow channel defined by the radially inner and outer bounding walls, the supporting ribs having a leading edge, a trailing edge, and side walls extending between the leading edge and the trailing edge, the side walls directing gas flow traversing the crossflow channel;

the housing being an intermediate housing of two turbines of a gas engine;

the radially outer bounding wall having a contour changing in a circumferential direction at least in one section upstream of the supporting ribs;

wherein an axial position of a bounding wall section or of the bounding wall point of minimal radius of curvature changes in the circumferential direction in such a way that the bounding wall point of minimal radius of curvature is positioned maximally upstream at a circumferential position of the leading edge of the supporting ribs, and maximally downstream at a circumferential position of one half pitch between two adjacent supporting ribs of the plurality of supporting ribs.

10. A housing comprising:

a radially inner bounding wall;

a radially outer bounding wall;

a plurality of supporting ribs within a crossflow channel defined by the radially inner and outer bounding walls, the supporting ribs having a leading edge, a trailing edge, and side walls extending between the leading edge and the trailing edge, the side walls directing gas flow traversing the crossflow channel;

the housing being an intermediate housing of two turbines of a gas engine;

the radially outer bounding wall having a contour changing in a circumferential direction at least in one section upstream of the supporting ribs;

wherein a radial position of a bounding wall section or of the bounding wall point of minimal radius of curvature changes in the circumferential direction in such a way that the bounding wall point of minimal radius of curvature is positioned maximally radially outwardly at a circumferential position of the leading edge of the supporting ribs, and maximally radially inwardly at a circumferential position of one half pitch between two adjacent supporting ribs of the plurality of supporting ribs.

* * * * *